US006999089B1

(12) United States Patent
Lam et al.

(10) Patent No.: US 6,999,089 B1
(45) Date of Patent: Feb. 14, 2006

(54) OVERLAY SCAN LINE PROCESSING

(75) Inventors: Fong-Shek Lam, Folsom, CA (US); Kim A. Meinerth, Granite Bay, CA (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 09/539,637

(22) Filed: Mar. 30, 2000

(51) Int. Cl.
*G09G 5/397* (2006.01)

(52) U.S. Cl. ..... 345/546; 345/545; 345/547; 345/558; 345/560

(58) Field of Classification Search ..... 345/547, 345/558, 545, 560, 546, 548, 543, 544
See application file for complete search history.

(56) References Cited

U.S. PATENT DOCUMENTS 5,043,714 A * 8/1991 Perlman ..... 345/560
5,526,024 A * 6/1996 Gaglianello et al. ..... 345/185
5,657,055 A * 8/1997 Kansal et al. ..... 345/189
5,694,141 A * 12/1997 Chee ..... 345/3.1
5,739,868 A * 4/1998 Butler et al. ..... 348/584
5,808,630 A * 9/1998 Pannell ..... 345/546
5,917,959 A * 6/1999 Kagawa et al. ..... 382/276
6,044,419 A * 3/2000 Hayek et al. ..... 710/57
6,172,669 B1 * 1/2001 Murphy et al. ..... 345/199
6,272,252 B1 * 8/2001 Eldridge et al. ..... 382/232

* cited by examiner

*Primary Examiner*—Kimbinh T. Nguyen
(74) *Attorney, Agent, or Firm*—Fish & Richardson P.C.

(57) ABSTRACT

An overlay video processing system provides an early start to pixel processing for the next overlay scan line. The overlay processor begins processing the next overlay scan line while still displaying the current scan line. A FIFO buffer is used to provide the overlay video data to the display. When the buffer provides a predetermined amount of data to the current overlay scan line, the buffer begins to load the data for the next overlay scan line. In one embodiment, the buffer may begin loading data for the next overlay scan line when approximately half the current overlay scan line is displayed.

22 Claims, 2 Drawing Sheets

OVERLAY SCAN LINE PROCESSING

TECHNICAL FIELD

This invention relates to computer display systems, and more particularly to processing overlay scan lines in computer display systems.

BACKGROUND

Conventional computer systems generate pixel maps to represent graphics images. A pixel map is a two dimensional array of pixel values where each pixel value indicates information including color for a corresponding pixel on a monitor or other video display.

Video overlay is the placement of a full-motion video window on the display screen. Video overlay systems can insert into a graphics image a video image such as might be generated by a television tuner, a video camera, VCR, or a video decoder. Video overlay systems commonly include software that generates a pixel map representing the graphics image and provides in the graphics image a video window which is filled with a color key. A separate device such as a video capture card generates the video image.

Current video overlay systems use the horizontal blank time start as an indicator to start processing pixels for the next overlay scan line. This technique was sufficient with lower resolution monitors that have long horizontal blank times. However, higher resolution monitors and flat panel displays have significantly reduced the amount of horizontal blank time. Thus, higher memory bandwidth is needed to ensure the pixel processing is completed in sufficient time to display the next overlay scan line.

DESCRIPTION OF DRAWINGS

Features and advantages of the invention will become more apparent upon reading the following detailed description and upon reference to the accompanying drawings.

DETAILED DESCRIPTION

Figure 1:
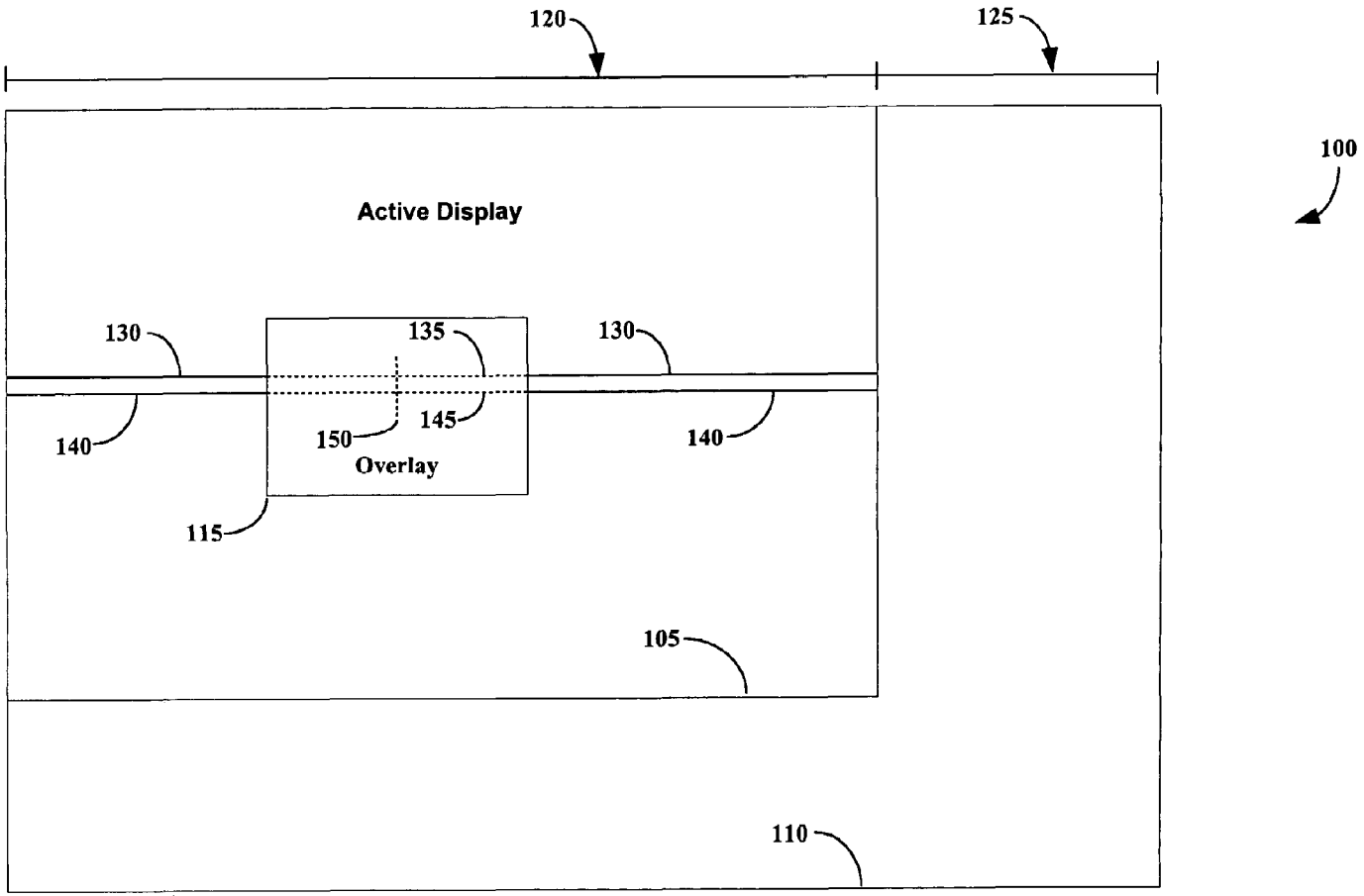
FIG. 1 illustrates a computer display including an overlay window according to one embodiment of the present invention.

FIG. 1 illustrates a computer display 100 including an overlay window 115 according to one embodiment of the present invention. The computer display 100 includes an overall display 110, an active display 105, the overlay window 115, horizontal active time 120, horizontal blank time 125, a first display line 130, a current overlay display line 135, a second display line 140, a next overlay display line 145, and an overlay display position indicator 150. The active display 105 represents the portion of the computer display 100 visible to the user. The overlay window 115 places full-motion video on the display screen. The overlay window 115 may display, for example, video from a DVD-ROM drive. The overlay window 115 may be positioned at any point in the active display 105.

The overlay window 115 is generated by processing and displaying consecutive overlay display lines. The combination of a plurality of these overlay display lines creates the overlay display window. For simplification purposes, the operation of the overlay display window 115 is described showing a current overlay display line 135 and a next overlay display line 145.

The processing of the overall display 110 is divided into multiple sections, including the horizontal active time 120 and the horizontal blank time 125. The horizontal active time 120 represents the time during which the active display 105 is processed. The active display 105 processes a first line 130 during the horizontal active time 120. When an overlay display window is active, the current overlay display line 135 is processed during the horizontal active time 120. After the first display line 130 is processed, the overall display 110 waits for a period of time, the horizontal blank time 125, before processing the second display line 140. Previous display systems also waited until the end of the horizontal active time 120 before processing the next overlay display line 145. With more advanced and higher resolution displays, the horizontal blank time 125 is significantly reduced. Thus, higher memory bandwidth is needed to ensure the pixel processing is completed in sufficient time to display the next overlay scan line 145.

To allow additional time to process the next overlay scan line 145 and therefore reduce the need to have increased memory bandwidth, the present invention uses the overlay display position indicator 150. The overlay display position indicator 150 may be located at any location along the current overlay scan line 135. In one embodiment of the invention, the overlay display position indicator 150 is located at approximately the midpoint of the current overlay scan line 135. Locating the overlay display position indicator 150 at the midpoint of the current overlay scan line 135 allows the video buffer providing data for the overlay window 115 to be approximately half-empty before beginning the processing for the next overlay scan line 145. By beginning the processing for the next overlay scan line 145 at the midpoint of displaying the current overlay scan line 135, the next overlay scan line 145 is processed during horizontal active time 120. Of course, when the current overlay scan line 135 is fully displayed, the buffer can begin processing the final portion of the next overlay scan line 145.

Figure 2:
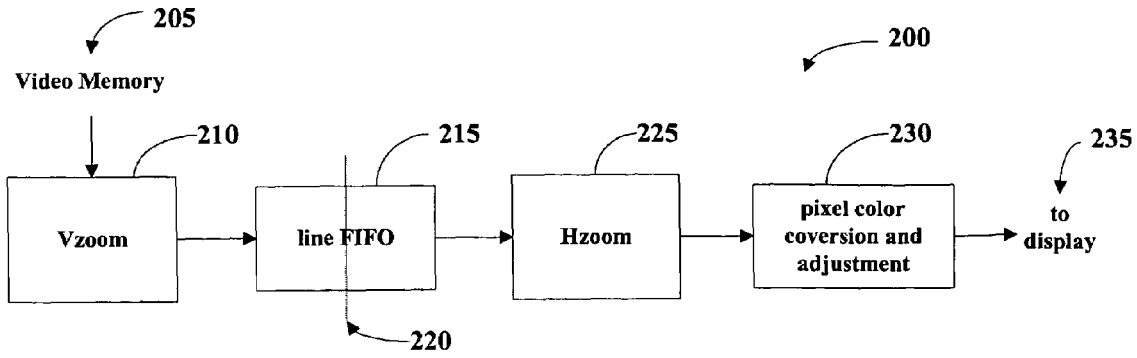
FIG. 2 illustrates a pixel processing engine according to one embodiment of the present invention.

FIG. 2 illustrates a pixel processing engine 200 according to one embodiment of the present invention. The pixel processing engine includes an input from video memory 205, a vertical zoom ($V_{zoom}$) 210, a video buffer 215 having a position indicator 220, a horizontal zoom ($H_{zoom}$), a pixel color conversion and adjustment stage 230, and an output 235 to the display. The pixel processing engine 200 generates the pixel information necessary to display the overlay window 115. The pixel processing engine 200 creates the overlay window 115 by generating a plurality of overlay scan lines.

The pixel processing engine 200 receives video data at an input from the video memory 205. The video data is processed by a $V_{zoom}$ 210. The $V_{zoom}$ 210 is a vertical filter that processes the video data to provide any adjustments in the vertical direction. After processing by the $V_{zoom}$ 210, the video data is sent to a video buffer 215. In one embodiment, the video buffer 215 is a first-in, first-out (FIFO) buffer. The video buffer 215 may include a position indicator 220 showing the buffer location of the last item of data processed. The video buffer 215 provides storage for the video data until the video data is sent to the display.

After leaving the video buffer 215, the video data is processed by a $H_{zoom}$ 225. The $H_{zoom}$ 225 is a horizontal filter that processes the video to provide any adjustments in the horizontal direction. After processing by the $H_{zoom}$ 225, the video data is sent to the pixel color conversion and adjustment stage 230 for further processing. The pixel color conversion and adjustment stage 230 performs the final processing and adjustment to the video data before being sent to the display. The details of the processing are known to one of skill in the art and will not be discussed herein. After final processing, the video data is provided to the output 235 for transmission to the display.

Figure 3:
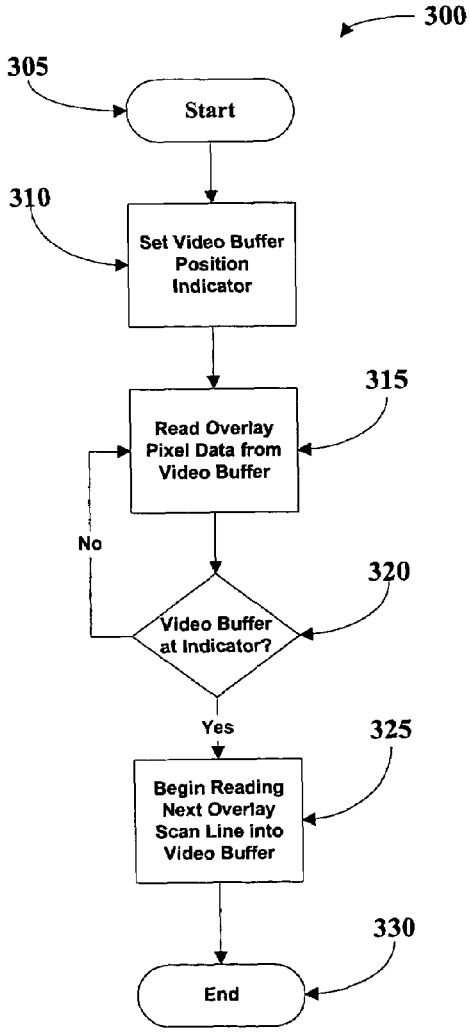
FIG. 3 is a flowchart showing the overlay data loading process used by a pixel processing engine according to one embodiment of the present invention.

FIG. 3 shows the overlay data loading process 300 used by the pixel processing engine 200 in FIG. 2. The process 300 begins at a start state 305. Proceeding to state 310, the process 300 sets the position indicator 220 at a predetermined location in the video buffer 215. In one embodiment, the position indicator 220 is set at approximately the midpoint of the video buffer 215. Of course, the position indicator 220 may be set at any point in the buffer without departing from the spirit of the invention.

Proceeding to state 315, the overlay pixel data is read from the video buffer 215 and provided to the display. The overlay pixel data is used to build the current overlay data line 135 in the overlay window 115. With each bit of pixel data read, the memory location to read from the video buffer 215 is incremented.

Proceeding to state 320, the process 300 determines if the last pixel data was retrieved from the buffer at the indicator location. For example, if the indicator is at the midpoint of the buffer, the current overlay data line 135 in the overlay window 115 will be half-drawn when the buffer memory location reaches the indicator. If the buffer has not reached the indicator, the process 300 proceeds along the NO branch back to state 315. In state 315, the process 300 continues to read data from the buffer to draw the current overlay data line 135. The process 300 remains in this loop until the current overlay data line 135 is drawn to a point where the indicator is reached.

Returning to state 320, if the video buffer has reached the indicator, the process 300 proceeds along the YES branch to state 325. In state 325, the pixel processing engine 200 begins to read data from the video memory for the next overlay data line 140. This loads the video buffer with data for the next overlay data line 145 prior to the completion of drawing of the current overlay data line 135. After the pixel processing engine begins loading data for the next overlay data line 145, the process 300 terminates in end state 330.

Numerous variations and modifications of the invention will become readily apparent to those skilled in the art. Accordingly, the invention may be embodied in other specific forms without departing from its spirit or essential characteristics.

What is claimed is:

1. A method of using a pixel processing engine to create an overlay window by generating a plurality of lines of video overlay data, the method comprising:

processing video data in the pixel processing engine;

sending the processed video data to be stored in a line buffer;

utilizing a video memory bandwidth twice for each full line of video overlay data stored in the line buffer, wherein the utilizing the video memory bandwidth twice comprises:

setting an indicator in a line buffer, the line buffer to store up to the full line of video overlay data for the overlay window;

reading pixel data for a current video line from the line buffer;

determining when the pixel data reaches the indicator;

loading pixel data for a first half of a next video line into the line buffer based on the determining when the pixel data for the current video line reaches the indicator, wherein the indicator is at approximately a middle of the line buffer; and loading pixel data for a second half of the next video line into the line buffer based on determining when the line buffer is about empty of the current video line of pixel data; and sending the stored video data from the line buffer to be displayed.

2. The method of claim 1, further comprising utilizing the video memory bandwidth twice for each full line of video overlay data stored in the line buffer to reduce a requirement for an amount of horizontal blanking (Hblank) time for a display monitor.

3. The method of claim 1, further comprising processing the current video line data for display.

4. The method of claim 3, further comprising displaying the processed video line data.

5. The method of claim 4, further comprising creating a video overlay from the processed video line data.

6. The method of claim 1, further comprising positioning the pixel data on an active display to create a video overlay.

7. A method comprising:

setting an indicator in a line buffer, the line buffer to store up to a full line of video overlay data;

reading pixel data for a current video line from the line buffer;

determining when the pixel data reaches the indicator;

loading data for the next video line into the line buffer based on the determining when the pixel data reaches the indicator wherein setting the indicator in the line buffer comprises setting the indicator at approximately a middle of the line buffer, wherein loading data for the next video line into the line buffer comprises utilizing a video memory bandwidth twice for each full line of video overlay data stored in the line buffer to reduce a requirement for an amount of horizontal blanking (Hblank) time for a display monitor, wherein loading data for the next video line into the line buffer further comprises loading a first half of the data for the next video line when the pixel data being read reaches the indicator in the line buffer, and further comprises loading a second half of the data for the next video line when the pixel data being read reaches the end of the line buffer.

8. A method of processing video overlay data comprising:

reading video overlay data for a current video line from a line buffer, the line buffer to store up to a full line of the video overlay data;

detecting the position in the line buffer where the video overlay data is located;

loading data for the next video line into the line buffer when the video overlay data for the current video line is located at a predetermined position approximately at a middle of the line buffer, wherein loading data for the next video line comprises:

loading a first portion of data or the next video line into the line buffer when the video data from the predetermined position has been read; and loading a second portion of data for the next video line into the line buffer when the video data from the end of the line buffer has been read.

9. The method of claim 8, further comprising setting the predetermined position at a position before all the current line of video overlay data is read.

10. The method of claim 8, further comprising utilizing a video memory bandwidth twice for each full line of video overlay data stored in the line buffer.

11. The method of claim 8, further comprising processing the current video line data for display.

12. The method of claim 11, further comprising displaying the processed video line data.

13. A method of reducing a timing requirement for a horizontal blanking (Hblank) time for processing video overlay data, the method comprising:

reading video overlay data for a current video line from a line buffer, the line buffer to store up to a full line of the video overlay data;

detecting the position in the line buffer where the video overlay data is located; and loading data for the next video line into the line buffer when the video overlay data for the current video line is located at a predetermined position, wherein the predetermined position is at approximately a midpoint of the line buffer, and wherein loading data for the next video line into the line buffer comprises loading a first half of the data for the next video line after the video data for the current video line has been read from the predetermined position; and loading a second half of the data for the next video line after the video data for the current video line has been read from the end of the line buffer.

14. An overlay display processor comprising:

a line buffer to store up to a full line of video overlay data, the line buffer configured to have a plurality of memory locations, the line buffer configured to provide data to a display;

an indicator configurable to be positioned at a predetermined memory location approximately in a middle of the line buffer, wherein the line buffer is configured to begins to read data for a first halt of a next video data line when the line buffer provides data from the indicator memory location, and wherein the line buffer is further configured to read a second half of the next video data line when the line buffer is empty of data for a current video data line; and graphic memory to provide the video pixel data to the line buffer, wherein a video memory bandwidth is configured to be utilized twice for each full line of video overlay data stored in the line buffer.

15. The computer of claim 14, further comprising:

a pixel processing engine to determine whether data for the current video line has been read from the predetermined memory location in the line buffer, the pixel processing engine further configured to subsequently load a the first half of data for the next video line into the line buffer.

16. The computer of claim 14, wherein the line buffer is configured to provide data to the display for the current video line.

17. The overlay display processor of claim 14, wherein the video memory bandwidth is configured to be utilized twice to reduce a requirement for an amount of horizontal blanking (Hblank) time for the display.

18. An overlay display system comprising:

a video memory to which stores video data;

an overlay processing engine comprising:

a line buffer to store up to a full line of video overlay data, the line buffer to receive the video overlay data from the video memory, wherein said line buffer includes an indicator positioned at a predetermined memory location in the line buffer, wherein the predetermined memory location comprises approximately a middle point of the line buffer;

video processing circuitry to prepare the video overlay data in the line buffer to be displayed; and a display to receive the processed data from the overlay processing engine, wherein the line buffer is configured to read data for a next video data line when the line buffer provides a predetermined amount of data to the display for a current video data line, wherein a requirement for an amount of horizontal blanking (Hblank) time for the display is reduced by having a first half of data for the next video data line in the line buffer before a beginning of a horizontal blanking interval is reached.

19. The overlay display system of claim 18 wherein the predetermined amount of data is approximately one half of the data comprising the current video data line.

20. The computer of claim 18, wherein the overlay processing engine is configured to provide data to the display to create a video overlay.

21. The computer of claim 18, wherein the video processing circuitry includes pixel color conversion and adjustment.

22. A program storage device readable by a machine comprising instructions that cause the machine to:

process video data in a pixel processing engine;

send the processed video data to be stored in a line buffer; and utilize a video memory bandwidth twice for each full line of video overlay data stored in the line buffer to reduce a requirement for an amount of horizontal blanking (Hblank) time for a display, wherein utilizing the video memory bandwidth twice comprises instructions to:

set an indicator in a line buffer, the line buffer to store up to the full line of video overlay data for the overlay window;

read pixel data for a current video line from the line buffer;

determine when the pixel data reaches the indicator; and load pixel data for a first half of a next video line into the line buffer based on the determining when the pixel data for the current video line reaches the indicator, wherein the indicator is at approximately a middle of the line buffer; and load pixel data for a second half of the next video line into the line buffer based on determining when the line buffer is about empty of the current video line of pixel data; and send the stored video data from the line buffer to be displayed.

* * * * *

UNITED STATES PATENT AND TRADEMARK OFFICE

CERTIFICATE OF CORRECTION

PATENT NO. : 6,999,089 B1
APPLICATION NO. : 09/539637
DATED : February 14, 2006
INVENTOR(S) : Lam et al.

It is certified that error appears in the above-identified patent and that said Letters Patent is hereby corrected as shown below:

In column 5, at line 39, delete “halt” and insert --half--.
In column 6, at line 2, delete “which stores” and insert --store--.

Signed and Sealed this

Twenty-seventh Day of November, 2007

JON W. DUDAS
*Director of the United States Patent and Trademark Office*